United States Patent [19]

Martin et al.

[11] 4,187,518

[45] Feb. 5, 1980

[54] TIMING DEVICE

[75] Inventors: Jean-Claude Martin, Neuchâtel; Jean F. Perotto, Hauterive, both of Switzerland

[73] Assignee: Centre Electronique Horloger SA, Neuchâtel, Switzerland

[21] Appl. No.: 871,541

[22] Filed: Jan. 23, 1978

[30] Foreign Application Priority Data

Feb. 21, 1977 [CH] Switzerland ..... 2140/77

[51] Int. Cl.[2] ..... G04B 27/00; G04C 9/00

[52] U.S. Cl. ..... 358/93; 58/23 R; 58/35 W; 58/85.5; 76/6

[58] Field of Search ..... 358/93; 58/23 R, 35 W, 58/85.5; 73/6

[56] References Cited

U.S. PATENT DOCUMENTS 4,035,833 7/1977 Shepard ..... 358/10
4,051,663 10/1977 Chihara ..... 58/35 W
4,077,049 2/1978 Baer ..... 358/93

FOREIGN PATENT DOCUMENTS 2159716 6/1973 Fed. Rep. of Germany .
2539224 3/1976 Fed. Rep. of Germany .
1416941 12/1975 United Kingdom .

*Primary Examiner*—Howard W. Britton
*Attorney, Agent, or Firm*—Stevens, Davis, Miller & Mosher

[57] ABSTRACT

A timing device comprises an oscillator a time base, a time display device and a control device intermediate between the oscillator and the display. In addition, it comprises a pickup for low-frequency pulses radiated by a conventional television receiver, and a treatment circuit having one input connected to the pickup, and one output connected to a means for regulation of the control device, for producing rate regulation and/or resetting.

17 Claims, 23 Drawing Figures

FIG_8A
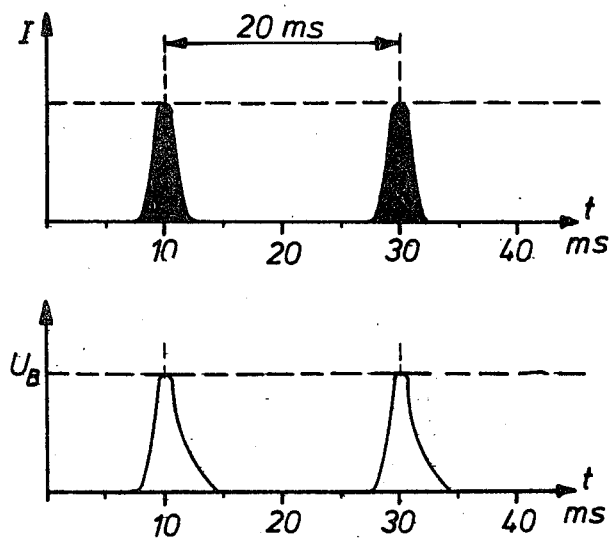
FIG_8B
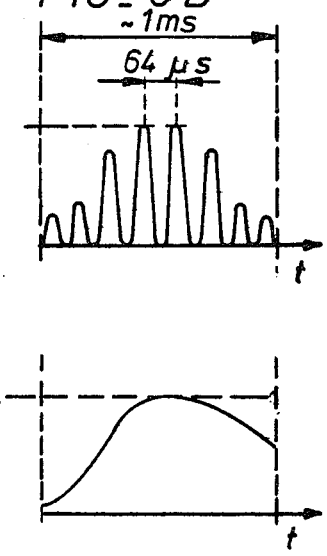
FIG_9A
FIG_9B
FIG_10
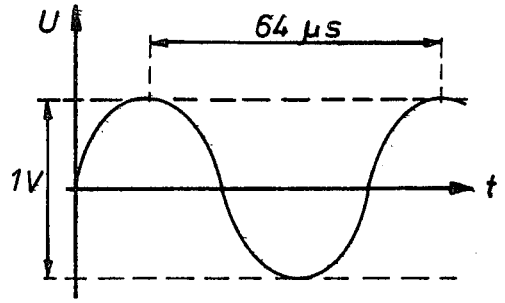
FIG_14
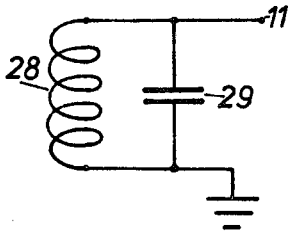
FIG_15
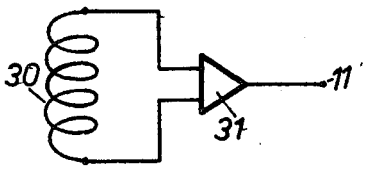
FIG_16
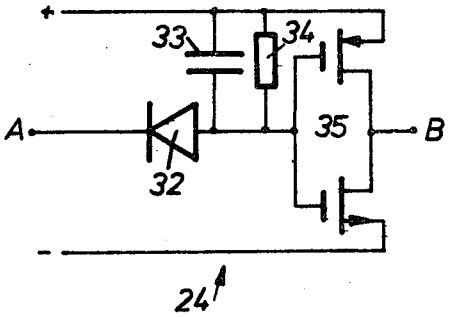

TIMING DEVICE

The present invention relates to a timing device equipped with a regulating means.

Resetting is a phase regulation, regulation of rate is a frequency regulation. The present invention offers an advantage for both.

In order to regulate the rate of a mechanical watch it was in the past necessary to place it under observation, and the owner was deprived of his watch for several days. At present, recourse is frequently made to an electronic apparatus which rapidly measures the momentary rate of a watch and permits of effecting its regulation. This burdensome apparatus is in general available only to the specialist watchmaker.

More recently a timing device has been developed equipped with a learning device and a regulating input for a standard time signal, which has made it possible to considerably reduce the drawbacks of the earlier systems as regards regulation of rate.

However an ad hoc apparatus to supply the reference was still necessary. Such a system is the subject of Swiss Pat. No. 570,651.

More recently again this latter system has been the subject of an improvement further facilitating the procedure in that several distant users can conveniently utilize one common installation; in this system the regulation is reduced in practice to a telephone call, the watch being equipped with an adequate telephone pickup, which may be magnetic or acoustic but not galvanic. However the called station must be suitably equipped with an answerer and a time reference generator. In this system the rate regulation can be effected as easily as the resetting. Such a system is described in Swiss Patent Application No. 13,779/74.

The present invention has the purpose of advancing one stage further along this way, by supplying a still more convenient means for regulating or resetting a watch.

The basic idea of the invention consists in utilizing one of the radiations existing in the vicinity of an ordinary television receiver.

These radiations in the form of pulses are available without special arrangements either of the television transmitter or of the television receiver, and are capable of supplying a reference frequency of excellent precision, since it is the actual precision of the reference oscillators which television transmitter stations utilize.

Thus the timing device according to the invention, which comprises an oscillator as a time base, a time display device and a control device intermediate between the oscillator and the display, is characterized in that it comprises at least one pickup for low-frequency pulses radiated by a television receiver and a treatment circuit having an input connected to the pickup and an output connected to a means for regulating the control device, for producing at least one of the operations of rate regulation and resetting.

It will be noted that this stage has eliminated the necessity of a special installation by permitting the use of a conventional television set receiving ordinary programs, without transformation.

It will likewise be noted that the timing device comprises no radio or television receiver the integration of which into a watch would present difficulties which at present are almost insurmountable. According to the invention low-frequency pulses are picked up, that is to say essentially of the order of 10,000 to 20,000 Hz for the line frequency and of the order of 50 to 60 Hz for the frame frequency. Thus the invention could not be compared with a radio-controlled clock.

The invention will be better understood with the aid of the description given below with reference to the drawing, wherein:

FIG. 1 illustrates the principle of the invention,

FIG. 2 represents diagrammatically a timing device with a learning device for the rate regulation, FIG. 3 represents diagrammatically a timing device with automatic resetting, FIG. 4 represents a variant of the timing device with semi-automatic resetting, FIGS. 5 and 6 each show a variant of a timing device with an adjustable electronic divider controlled by a learning device, FIG. 7 shows the potential U in the course of the time t which is measured at the terminal 11 of a capacitive pickup of the type shown in FIG. 11, close to an operating television set, FIGS. 8A and 8B shows an example of the luminous intensity I received by a detector placed against the screen of an operating television set, FIGS. 9A and 9B corresponds to FIG. 8 as regards time scale and shows the potential $U_B$ at the point 11 of an optical pickup of the type shown in FIG. 13, FIG. 10 shows the potential U which is measured at the terminal 11 of an inductive pickup of the type shown in FIG. 14, close to an operating television set, FIG. 11 illustrates the principle of a capacitive pickup, FIG. 12 shows an input circuit, FIG. 13 shows a diagram of an optical pickup, FIGS. 14 and 15 each show a variant of an inductive pickup, FIG. 16 shows a presence circuit, FIG. 17 is a time diagram of signals of the circuit according to FIG. 16, FIG. 18 shows a timing device with means for producing a pulse of standard duration, FIG. 19 shows a detail of FIG. 18, FIGS. 20 and 21 are time diagrams of logic signals.

In FIG. 1, a television receiver 100, when it picks up a transmission, emits low-frequency pulses 105 of different natures. It is a matter of the optical blinking corresponding to the spot and having the frequency of the line sweep or of the change of frame or image; it is also a matter of electric or magnetic pulses easily detectable in the vicinity of the television set and due to the sweep control circuits. These pulses always carry at least one frequency information item with excellent precision. However they can also comprise a previously coded information giving for example the exact time. The information can even consist of a call and one can imagine a call according to a key code which only the timing device of the person to whom the call is destined possesses.

The timing device according to the invention comprises at least one pickup 110 for these pulses. A treatment circuit 120 extracts the desired information from these pulses, which information can especially be the exact time as stated above, a time standard, or a call.

The timing device further comprises, like conventional timing devices, the elements which are the time base 130, the display device 160 and a control device 140 intermediate between these. These various elements can assume different forms.

The oscillator 130 can deliver electric pulses, the control device comprising a frequency divider. The display 160 can be either mechanical, preferably moved by a step-by-step motor controlled by pulses, or a display by electro-optical transducers such as LEDs or LCDs, controlled by the control device.

The treatment circuit 120 is connected to the control device 140 so that it can act thereon for the rate regulation or resetting or both.

In FIG. 2 the oscillator 130 acts upon a frequency divider 144 the ratio of which is adjustable, controlled by a learning device 146. The divider controls control elements 148 acting upon the display 160. The treatment circuit 120 is arranged to effect the rate regulation by action upon the learning device. It should be noted that in the block diagram the rate regulation is foreseen, but this does not preclude the possibility of superposing the principle of rate regulation and that of resetting.

In FIG. 3 the divider 142 pilots the control element 148 controlling the display 160. The treatment circuit 120 is here capable of effecting the resetting by action upon these means 148. In the case of an electronic watch these means 148 comprise final frequency dividers by 60 for the minutes, possibly also for the seconds, and by 24 or 12 for the hours. These dividers control binary-decimal decoders which activate the LED or LCD display. These means are well known to the person acquainted with the art. The treatment circuit acts by imposing upon the said dividers the state corresponding to the exact time.

In FIG. 4 the resetting is semi-automatic. The oscillator 130 delivers electric pulses by way of the gate 135 to the control device 140. As in FIG. 1, this device controls a display device 160. This display possesses a manual resetting input 165, which can for example be a rotating crown.

The principle is that of resetting by manual preselection and automatically synchronized starting. The user operates the display by a control 165 to set it to a defined time, with zero minute, for example exactly 9 o'clock, this taking place a few moments before it is exactly 9 o'clock. At the same time he stops the running by actuating a contactor (not shown) connected by the line 167 to the zeroing input of a flip-flop 137 which controls the gate 135. Then the watch is subjected to the pulses carrying the time information. At the moment of change of hour, the treatment circuit 120 sends a pulse to the flip-flop 137 to set it to 1, the flip-flop then liberating the gate 135, this ensuring synchronized starting.

FIG. 5 concerns an example of rate regulation for a watch with time base delivering electric pulses feeding a logic frequency divider of adjustable ratio controlled by a memory equipped with a learning device. It will be seen hereinafter what means the treatment circuit 120 can comprise to permit regulation according to this method. For the moment il will merely be stated that the circuit 120 is capable of supplying a pulse whose duration, for example 1 second, is very exact and serves as standard.

The manner of exploiting such a standard has already been the subject of Swiss Pat. No. 570,651 (see especially FIG. 2 of this Patent). It is unnecessary to recall the principle thereof.

The oscillator 130 acts upon a divider formed by a chain 240 of frequency dividers by two. This divider 240 in principle supplies a pulse of 1 Hz or ½ Hz to dividers by 60 (minutes and hours) and by 12 or 24 contained in the block 148 which controls the display 160. Let it be noted that these pulses of 1 Hz or ½ Hz could equally well actuate a step-by-step motor driving conventional gear trains of a display comprising movable elements.

The rapid stages of the divider are connected by a gate circuit 266 to memories 265. The circuit 262 comprises modulo 2 gates. For each of these gates one input is connected to a memory element, the other to a binary divider stage of the same rank as the memory element, the output being connected to the multiple AND-gate 219. The circuit 262 and the gate 219 form a comparator the output of which is at ONE if the said stages and the said memory elements are in the same state and if the output of the final flip-flop 242 of the divider 240 is at ONE. Then by way of the monostable circuit 220 sensitive to the rising pulse edge and the OR-gate 221, the divider 240 is reset to zero.

Thus the exact value of the period of the divider is a function of the content of the elements of the memory 265. These memory elements are charged to the necessary value through the learning which proceeds as follows:

The commencement of the standard pulse X, by way of the monostable circuit 227 and the gate 221, zeros the divider 240 and the memory 265. The divider 240 is thus free to count. The oscillator is assumed to be slightly too fast. When the end of the pulse X arrives, thus there will be a certain excess count in the stages of the divider 240. However the end of the pulse X, via the monostable circuit 226, causes precisely storage of this count, through the gate circuit 266, in the memory 265. The cooperation of the last flip-flop 242 and of the comparator 262–219 causes the cycle of the divider 240 to be completed only after the divider has received the memorized number of excess pulses. Thus the learning and regulation are realized.

In FIG. 6 an analogous realization is again seen, but the principle of the adjustable-ratio divider is slightly different. It has been the subject of Swiss Pat. No. 554,015 (see especially FIG. 5 of that Patent).

The principle consists in inhibiting the excess pulses. The memorization of the excess number in the memory 265 through a gate circuit 266 is analogous, but then one effects an inhibition of a corresponding number of pulses.

The circuit 261 comprises a series of AND-gates. For each of these gates one input is connected to a memory element and the other to a binary divider element of the chain 240, the output being connected to the multiple OR-gate 228. Thus a memory element being at ONE causes the emission, towards the OR-gate 228, of pulses produced by a stage of the frequency divider 240.

Each of these pulses causes the inhibition, at the level of the gate 218, of one pulse of the oscillator 130. In fact a pulse from the gate 228 sets the flip-flop 217 at zero, which blocks the gate 218 for a single pulse since, through the inverter 219, the next descending edge of a pulse from the oscillator 130 resets the flip-flop 217 at ONE, which thus again liberates the gate 218. Thus one inhibits a number of pulses determined by the content of the memory 265, which has been acquired by the standardization.

It is perfectly conceivable to adapt this principle to a timing device different from a purely electronic timing device. The above had the purpose of showing that the invention is capable of application in greatly different directions.

The following is concerned particularly with the pickup 110 and the treatment circuit 120.

Any ordinary television apparatus 100 (FIG. 1) radiates low-frequency pulses 105 of various natures which are easily detectable within a certain vicinity.

At least three types of pickups: capacitive, optical, inductive, are proposed for picking up the said pulses.

FIG. 11 illustrates the operation and assembly of a capacitive pickup installed in a watch case 1. The pickup consists of a transparent electrode 4 disposed beneath the watch glass 2, connected to the treatment circuit (not shown) by a terminal 11. The watch is held on the users wrist by a bracelet 3. When the wearer presents the watch 1 to a television screen, the assembly possesses:

A television-pickup capacitance 8 of the order of 0.1 pF,

A pickup-case capacitance 9 of the order of 2 pF, and

A wearer-earth capacitance 10 of the order of 200 pF.

The synchronisation pulses of the horizontal sweep of the television screen (line return) induce at 11 a potential of the order of a few volts which is perfectly usable to control the grid of a transistor MOS, as for example in the circuit in FIG. 12.

This circuit possesses a protection diode 14 and a resistance 15, advantageously realized in the form of polycrystalline silicon diode or diodes in accordance with the technique described in Swiss Patent CEH 175 No. 581,904 (1976).

The terminal 11 is connected to the grid of an inverter the output 12 of which supplies logic pulses in response to the picked up pulses.

FIG. 7 shows the potential U as a function of the time t which is observed at the terminal 1 of a capacitive pickup of type shown in FIG. 11 when it is in the vicinity of an operating television set. This signal corresponds to the return of the beam after each line; thus it has a very stable frequency of 10 to 20 kHz, according to the received signal standard. The peak value can be greater than 1 V and can thus directly control a CMOS inverter of an integrated watch circuit (FIG. 12).

FIG. 13 shows an example of an optical pickup formed by a circuit which comprises, in series between the + and − feed terminals, a control switch 56 which can be of electronic or mechanical type, a photodiode 25 and an RC-circuit formed of a resistance element 26 and a filtration capacitance 27 in parallel. The output terminal 11 is taken between the photodiode and the RC-circuit.

The photodiode 25 is preferably disposed beneath the watch glass. Such a realization, when the watch is brought close to an operating television screen, permits of picking up the frame frequency of 50 Hz or 60 Hz according to the television standard. The signal at the terminal 11 is preferably sent over a circuit of the same kind as that in FIG. 12.

FIG. 8A shows the appearance of optical signals in the vicinity of a television screen, and FIG. 8B represents the same signal on an expanded scale of times t.

FIGS. 9A and 9B show the appearance of corresponding electric signals, produced by an optical pickup such as that described above.

FIG. 14 shows an example of a tuned inductive pickup comprising a coil 28 and a capacitance 29. By way of example the signal according to FIG. 10 is obtained with an amplitude of 1 V if one has the following conditions:

Coil 28: 1000 turns, mean diameter: 14 mm, L: ~17 mH; Capacitance 29: C: ~6 nF; with: $2\pi f = 1/\sqrt{LC}$ wherein f is the line sweep frequency.

FIG. 10 shows what is received with such a magnetic detector.

FIG. 15 shows an untuned inductive pickup. A coil 30 of 10 turns of mean diameter 10 mm supplies a potential of several mV collected by the amplifier 31 which delivers a utilizable signal of about 1 V to the output terminal 11.

It is advantageous to provide a safety device which indicates whether the received signal is of sufficient quality.

FIG. 16 shows a form of embodiment of such a circuit.

Figure 12:
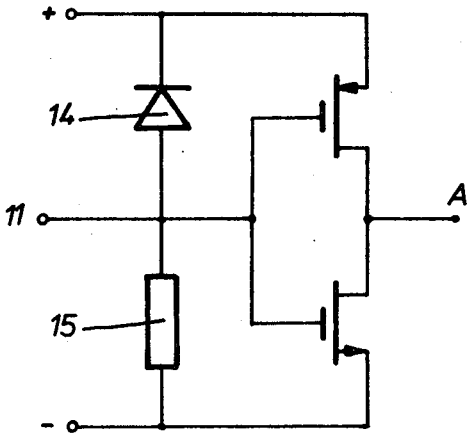
Figure 13:
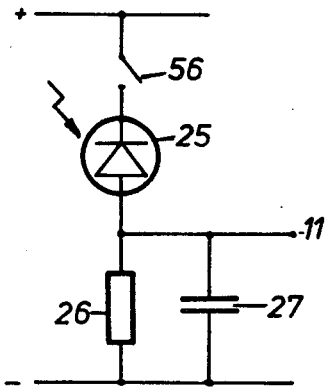

The terminal A of this circuit, called presence circuit 24, is connected to the logic output terminal 12 of the detection circuit in FIG. 12. The diode 32, the capacitance 33 and the resistance 34 form a rectifier which acts upon the grids of two complementary MOS transistors forming an inverter 35 connected to the output terminal B. The time constant $\tau = RC$ is clearly greater than the period of the logic signal supplied at A.

Figure 17:
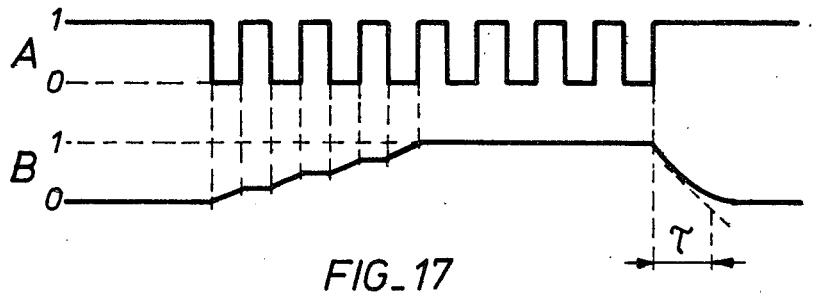

The operation, illustrated in FIG. 17, is as follows:

When the radiated pulses are absent or too weak to be detected, the point 11 (FIG. 12) is at negative potential, the point 12 (FIG. 12) and thus the point A are then fixed and at the positive + potential of the battery. The capacitance 33 is discharged, having the two points at positive potential. The output of the inverter 35 is thus at 0 and B=0.

When the pulses are detected the signal at the point A is alternately at the + and at the − of the battery. The capacitance 33 charges and after a few periods of the reference signal the output B passes to "1". It remains at "1" as long as the regulating signal is present. As soon as the signal A is too weak the capacitance 33 discharges through the resistance 34 and the output signal passes to "0".

Figure 1:
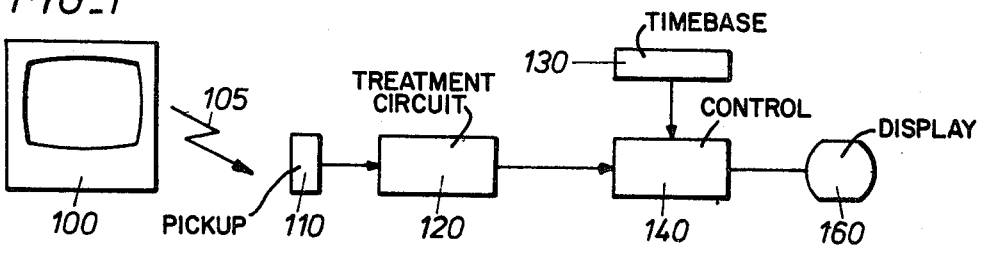
Figure 2:
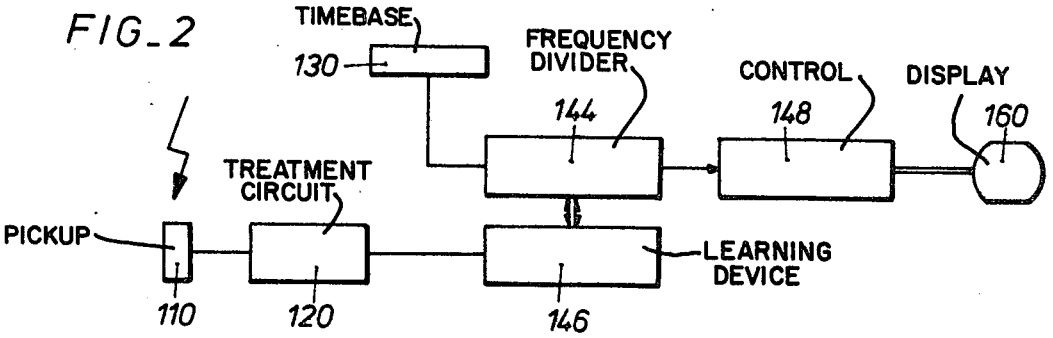
Figure 3:
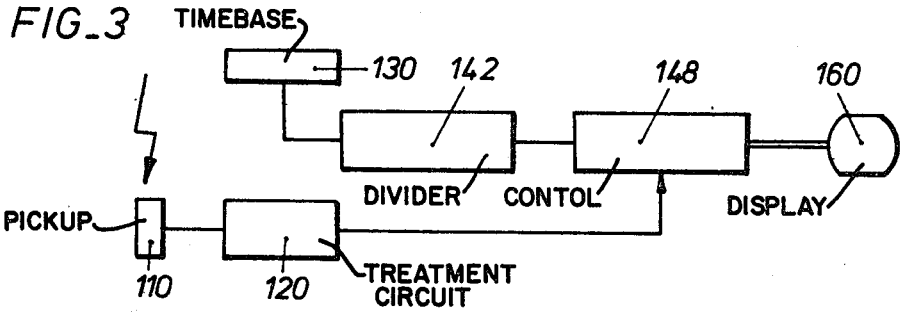
Figure 4:
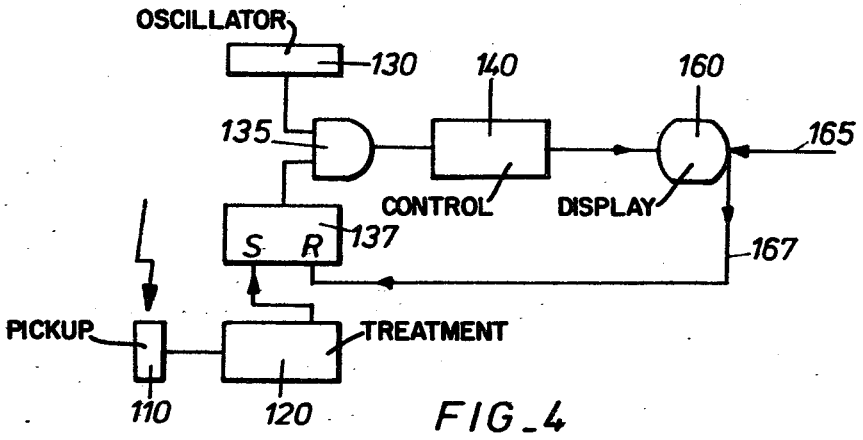
Figure 7:
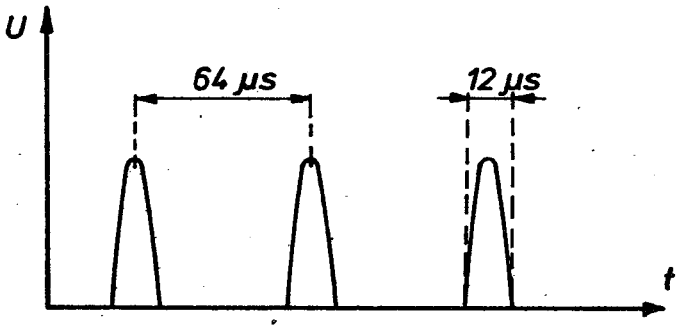
Figure 5:
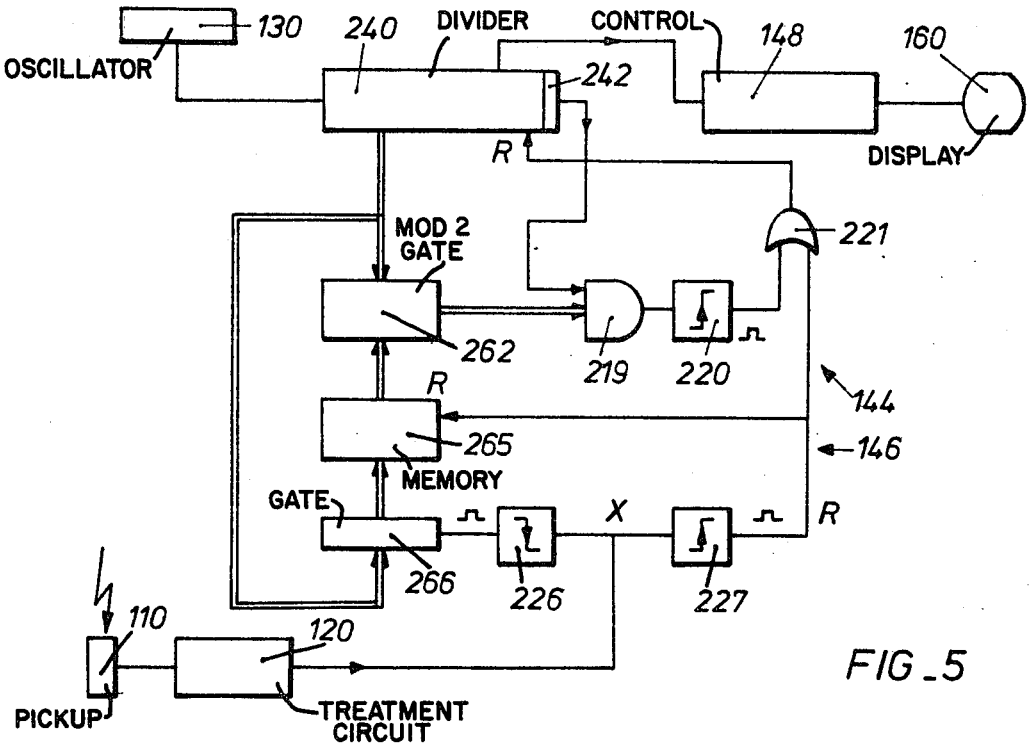
Figure 6:
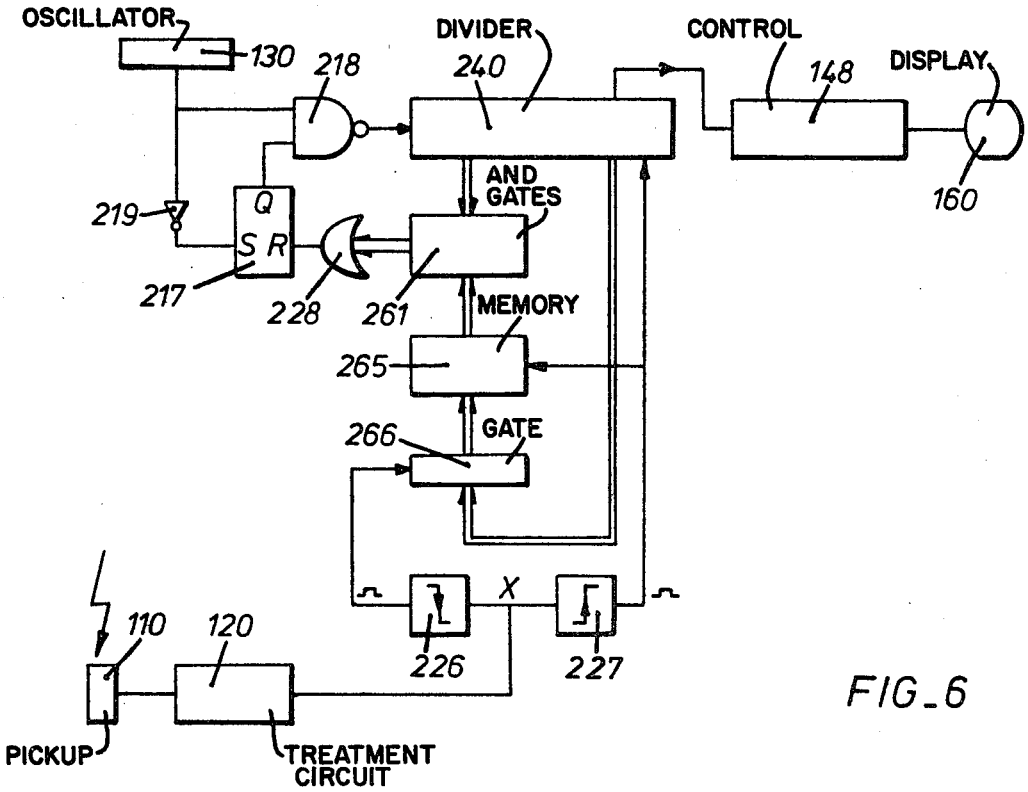
Figure 11:
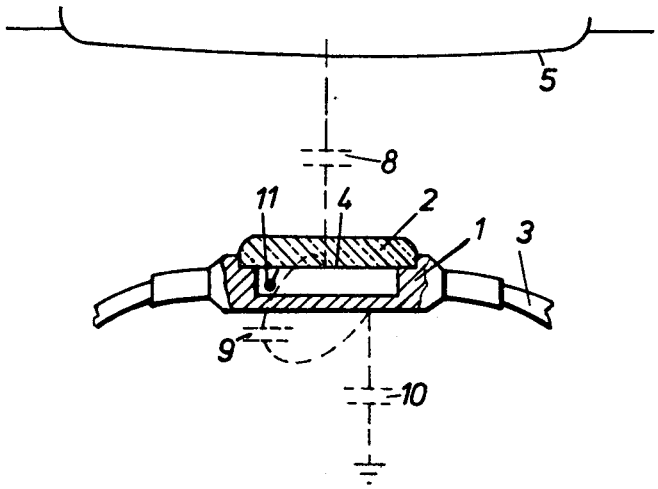

Various examples of pickups having been described and it having been shown how logic signals can be obtained therefrom in response to the line or frame synchronization pulses radiated by a television set, the means will now be described which the treatment circuit comprises for producing from these pulses a pulse of standard duration X as required for a learning circuit, as shown for example in FIGS. 5 and 6.

Figure 18:
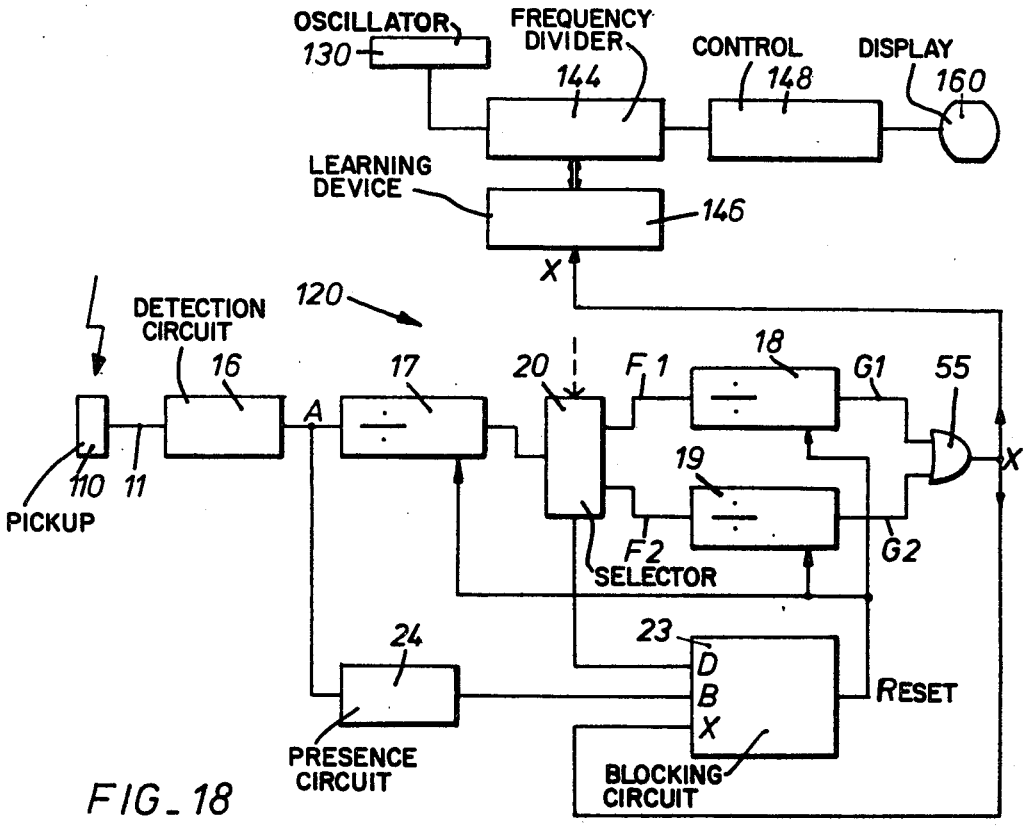

In FIG. 18 the pickup 110 is connected to the detection circuit 16 which was described with reference to FIG. 12. The output A of this detection circuit is connected to a presence circuit 24 which was described with reference to FIG. 16, and to a first divider 17. The output F of the divider 17 is connected to a selector 20 which directs the pulses towards one of two outputs F1, F2, as a function of the norm of the signal.

The outputs F1, F2 are connected each to a frequency divider 18, 19; the respective division factors are proportional to the synchronization frequencies of the respective norms in such manner as to obtain the same standard X. The two respective outputs G1, G2 terminate at an OR-gate 55 the output of which supplies the signal X.

This signal is transmitted to the learning device 146 where it is used for the regulation. The control of the selector 20 can be manual, but a decision circuit can be conceived which is capable of recognizing the norm of the pulses received and of acting consequently upon the selector 20. In fact, even if the watch is not yet finaly regulated, it supplies a sufficiently precise time base to permit a comparator to distinguish for example between the European 50 Hz and the American 60 Hz.

As to the division factors of the frequency dividers 17, 18 and 19, they depend upon the norms and the nature of the utilised pulses, also upon the desired duration of the pulse X. In order to clarify ideas, a first example will be taken.

The two possible norms correspond to the following data:

| Norm | Lines | Frame | Line synchronization |
|---|---|---|---|
| European | 625 | 50 Hz | 15,625 Hz |
| American | 525 | 60 Hz | 15,750 Hz |

One has $15{,}625 = 5^6$
$15{,}750 = 7 \cdot 5^3 \cdot 3^2 \cdot 2.$

The pulses are line synchronization pulses and the duration of the pulse X is 4 seconds. Therefore the blocks 17, 18 and 19 are formed from successive divider stages according to the following layout:

| | | |
|---|---|---|
| block 17: | : 8 : 5 : 5 : 5 | |
| block 18: | : 5 : 5 : 5 | for European norm |
| block 19: | : 7 : 3 : 3 : 2 | for American norm. |

In a second example, let it be supposed that in place of the line frequency the frame frequency is used, with the aid of an optical pickup. In this case there will be the following layout:

| | | |
|---|---|---|
| block 17: | : 8 : 5 : 2 | |
| block 18: | : 5 | for European norm |
| block 19: | : 3 : 2 | for American norm |

The initial division by 8 gives a period of 8 seconds, that is a half period or square-wave of 4 seconds as desired. This example with the regulating period X of 4 seconds corresponds to the example of line 43 of Swiss Pat. No. 570,651, already cited with reference to FIG. 5.

However it must be ensured that the pulses are reliable. To this end the output B of the presence circuit 24 is connected to a blocking circuit 23. This circuit 23 likewise receives the signal X and a signal D coming from the selector 21. This signal D starts the regulating procedure. The blocking circuit however permits the regulation only if the presence circuit 24 recognises a sufficient quality of the pulses A. The output R of the blocking circuit is connected to the zeroing terminals of the dividers 17, 18 and 19.

Figure 19:
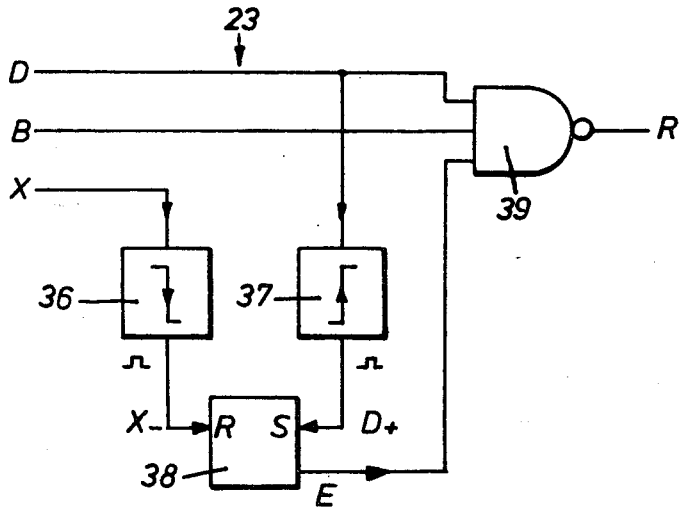

As shown in FIG. 19, which represents the blocking circuit 23, the signal D terminates at the monostable circuit 37 which reacts to the rising edge forming a pulse D+, which terminates at the input S of the flip-flop 38 the output signal E of which terminates at one of the three inputs of the NAND-gate 39.

The signal X terminates at the monostable circuit 36 which reacts to the descending pulse edge forming a pulse X−, which terminates at the input R of the flip-flop 38.

The other two inputs of the gate 39 receive the signals D and B, and the gate delivers a blocking signal R as soon as at least one of the inputs is in the zero logic state.

Figure 20:
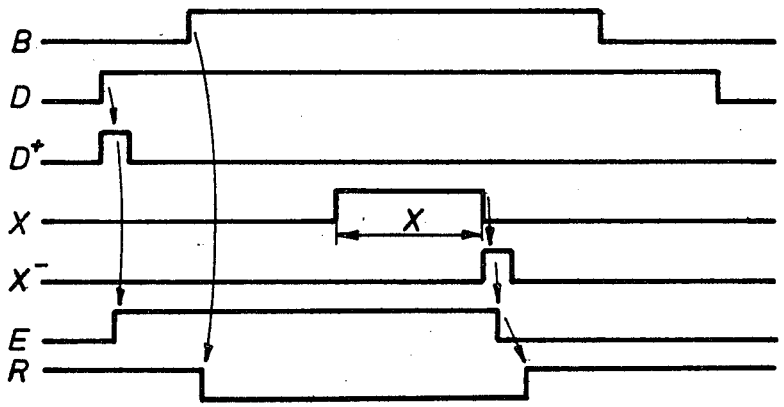

The operation of the blocking circuit appears clearly from the diagram in FIG. 20 which represents the typical appearance of the signals as a function of time.

Figure 21:
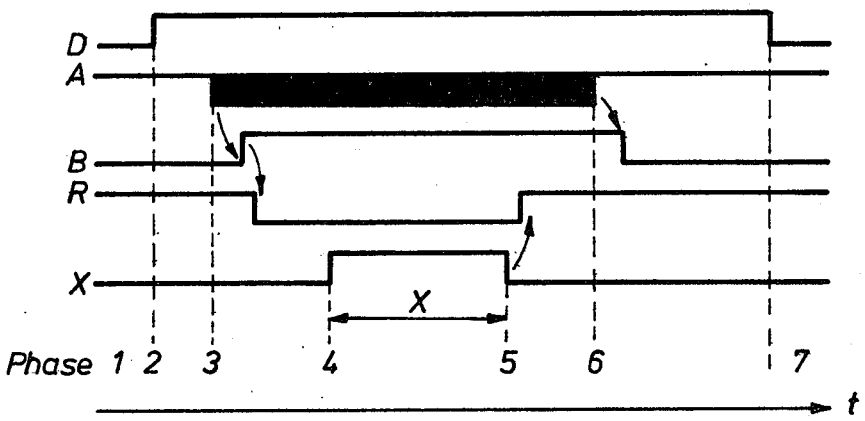

In the same manner FIG. 21 illustrates the succession of different phases of a regulation with reference to the circuit in FIG. 18.

Phase 1: Normal operation, but the watch is not yet regulated.

Phase 2: The norm of the television transmission available is preselected for example by manual action upon the selector 20, and the control signal D is set to 1.

The watch being far from the television set, no signal is yet detected and nothing else happens.

Phase 3: The watch is brought close to the television set.

The pickup 110 then picks up a signal.

The presence circuit 24 detects the presence of a signal of sufficient quality: B=1. The conditions of regulation are satisfied: B=1, D=1, E=1, the blocking circuit 23 then supplies R=0 thus unblocking the counters 17, 18 and 19.

Phase 4: After a certain number of pulses, the last stage of the counter selects 18 or 19, change of state and X=1. The commencement of the regulation period is thus fixed.

Phase 5: After a predetermined number of pulses a quite precise standard period has been supplied, and X=0.

The learning, effected by the circuit 146, is terminated. The blocking circuit then supplies R=1, returning all the counters 17, 18 and 19 to zero.

Phase 6: The watch is removed from the television receiver, A=1 and B=0.

Phase 7: Normal operation, D=0 and the watch is regulated.

In conclusion, in the present description it has been shown that the basic principles of the invention, that is the exploitation of pulses radiated by an ordinary television set, were capable of very advantageous concrete applications both in the field of time measurement and in other fields in accordance with the nature of the information which is drawn from these pulses.

I claim:

1. A timing device comprising an oscillator forming a time base, a time display device and a control device intermediate between the oscillator and the display for formatting display signals from said time base, characterized in that it comprises at least one pickup responsive to low-frequency pulses radiated by a television receiver and a treatment circuit for treating said pulses to extract control information therefrom, said treatment circuit having one input connected to the pickup and one output connected to a means for regulating the control device, said means for regulating being responsive to said treatment circuit to produce in said control device at least one of the operations of rate regulation and resetting.

2. A timing device according to claim 1 wherein said television radiations provide a time indication by a coding of said pulses, and further characterized in that said treatment circuit comprises time decoding means connected to the means for regulation of the intermediate control device to effect the resetting.

3. A timing device according to claim 1, in which the control device comprises a divider of adjustable frequency ratio and said means for regulation comprises a memory learning device controlling the division ratio and having a rate regulation input for a standard signal, characterized in that in response to the picked up pulses the treatment circuit supplies the standard signal at the regulation input.

4. A timing device according to claim 1, wherein said television radiations provide information by a coding of said pulses, and further characterized in that the treatment circuit comprises a means for decoding this information and in that said means for regulation controls, in response to this information, the starting and stopping respectively of at least one element of the display to indicate this information.

5. A timing device according to claim 1, characterized in that the pickup is a capacitive pickup which is responsive to the line synchronization pulses of a television display.

6. A timing device according to claim 5, further comprising a watch housing for said timing device including a watch glass, characterized in that the capacitive pickup consists of an electrode deposited beneath the glass of the watch.

7. A timing device according to claim 1, characterized in that the pickup is an inductive pickup which is responsive to the line synchronization pulses of a television display.

8. A timing device according to claim 7, further comprising a watch housing for said timing device and further characterized in that the inductive pickup is a coil placed inside said watch housing.

9. A timing device according to claim 1, characterized in that the pickup is an optical pickup sensitive to the passage of a scanning spot over the screen.

10. A timing device according to claim 9, further comprising a watch housing for said timing device and further characterized in that the optical pickup is a photoelectric cell placed beneath the glass of the watch.

11. A timing device according to claim 7, characterized in that the treatment circuit comprises a frame frequency detector.

12. A timing device according to claim 1, characterized in that the treatment circuit comprises means for treating the received pulses selectively according to one among several television norms and a norm selector.

13. A timing device according to claim 12, characterized in that the selector comprises external manual control means.

14. A timing device according to claim 12, characterized in that the selector is automatic and comprises means for recognising the norm to which the received pulses belong, and means for imposing this norm upon the treatment circuit.

15. A timing device according to claim 1, characterized in that it comprises an external manual control device for placing the treatment circuit into and out of operation.

16. A timing device according to claim 1, characterized in that it further comprises a safety circuit controlled by the pickup and comprising an integrator and locking means to permit the treatment of the pulses only if the integrator receives pulses of sufficient quality.

17. A timing device according to claim 16, characterized in that it comprises a display element controlled by the safety circuit to indicate to the user that the received pulses are of sufficient quality.

* * * * *